US009425555B1

(12) United States Patent
Liu et al.

(10) Patent No.: US 9,425,555 B1
(45) Date of Patent: Aug. 23, 2016

(54) PLUG CONNECTOR

(71) Applicant: Cheng Uei Precision Industry Co., Ltd., New Taipei (TW)

(72) Inventors: Feng-Tian Liu, Dong-Guan (CN); Lin-Kang Li, Dong-Guan (CN); Zhi Zhang, Dong-Guan (CN); Qiu-Xiang Mi, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 13 days.

(21) Appl. No.: 14/678,899

(22) Filed: Apr. 3, 2015

(51) Int. Cl.

| | |
|---|---|
| ***H01R 24/00*** | (2011.01) |
| ***H01R 13/642*** | (2006.01) |
| ***H01R 24/60*** | (2011.01) |
| ***H01R 12/70*** | (2011.01) |
| *H01R 107/00* | (2006.01) |

(52) U.S. Cl.
CPC ..... *H01R 13/642* (2013.01); *H01R 12/7076* (2013.01); *H01R 24/60* (2013.01); *H01R 2107/00* (2013.01)

(58) Field of Classification Search
CPC .... H01R 2107/00; H01R 24/60; H01R 12/57; H01R 13/506; H01R 13/502; H01R 13/405; H01R 13/26; H01R 43/24; H01R 13/514
See application file for complete search history.

(56) References Cited

U.S. PATENT DOCUMENTS

| | | | | |
|---|---|---|---|---|
| 7,625,236 | B1 * | 12/2009 | Wu | H01R 24/62 439/607.58 |
| 8,366,491 | B2 * | 2/2013 | Wu | H01R 12/55 439/660 |
| 8,591,265 | B2 * | 11/2013 | Huang | H01R 13/6597 439/660 |
| 9,153,926 | B2 * | 10/2015 | Wu | H01R 13/6585 |

* cited by examiner

*Primary Examiner* — Xuong Chung Trans
(74) *Attorney, Agent, or Firm* — Cheng-Ju Chiang

(57) ABSTRACT

A plug connector includes a lower terminal module, an upper terminal module and an insulating housing. The lower terminal module includes a lower insulator and a plurality of lower terminals integratedly molded in the lower insulator, each of the lower terminals has a lower contact portion beyond a bottom face of the lower insulator. The upper terminal module is engaged with the lower terminal module, includes an upper insulator and a plurality of upper terminals integratedly molded in the upper insulator, each of the upper terminals has an upper contact portion beyond a top face of the upper insulator. The insulating housing is integratedly molded outside the lower terminal module and the upper terminal module, each lower contact portion is exposed from a bottom face of the insulating housing, each upper contact portion is exposed from a top face of the insulating housing.

7 Claims, 6 Drawing Sheets

PLUG CONNECTOR

BACKGROUND OF THE INVENTION

1. Field of the Invention

The present invention relates to a connector, and more particularly to a plug connector adapted for normal insertion and reverse insertion into a receptacle connector.

2. The Related Art

With the development of the electronics industry, a USB 2.0 plug adapted for normal insertion and reverse insertion has emerged. A usual means for realizing the normal insertion and reverse insertion of the USB 2.0 plug is to add a group of conductive terminals in a reverse side of the USB plug connector. However, this will cause a series of problems, such as the strength of the USB plug connector is poorer, the conductive terminals are not convenient to assemble or molded in a housing of the USB 2.0 plug which brings a high manufacturing cost.

SUMMARY OF THE INVENTION

Accordingly, an object of the present invention is to provide a plug connector mounted on a printed circuit board. The plug connector includes a lower terminal module, an upper terminal module and an insulating housing. The lower terminal module includes a lower insulator and a plurality of lower terminals, each of the lower terminals has a lower fixing portion, a front of the lower fixing portion is drawn downward to form a lower contact portion beyond a bottom face of the lower fixing portion, the lower fixing portions of the lower terminals are integratedly molded in the lower insulator and arranged transversely, each lower contact portion is beyond a bottom face of the lower insulator, a rear of each lower fixing portion extends rearwards to form a lower solder portion beyond a rear of the lower insulator. The upper terminal module is engaged with the lower terminal module, the upper terminal module includes an upper insulator and a plurality of upper terminals, each of the upper terminals has an upper fixing portion, a front of the upper fixing portion is drawn upwards to form an upper contact portion beyond a top face of the upper fixing portion, the upper fixing portions of the upper terminals are integratedly molded in the upper insulator and arranged transversely, each upper contact portion is beyond a top face of the upper insulator, a rear of each upper fixing portion extends rearwards to form a upper solder portion beyond a rear of the upper insulator. An insulating housing is integratedly molded outside the lower terminal module and the upper terminal module, each lower contact portion is exposed from a bottom face of the insulating housing, each upper contact portion is exposed from a top face of the insulating housing.

As described above, the lower fixing portions of the lower terminals are integratedly molded in the lower insulator, the lower contact portions are beyond the bottom face of the lower insulator. The upper fixing portions of the upper terminals are integratedly molded in the upper insulator, the upper contact portions are beyond the top face of the upper insulator. The upper terminal module and the lower terminal module are engaged with each other and then integratedly molded in the insulating housing. Therefore, the plug connector is adapted for normal insertion and reverse insertion into a receptacle connector (not shown) to facilitate users' usage, at the same time, the lower terminals and the upper terminals are convenient to molded in the lower insulator and the upper insulator, the plug connector has strong structure and low manufacturing cost.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
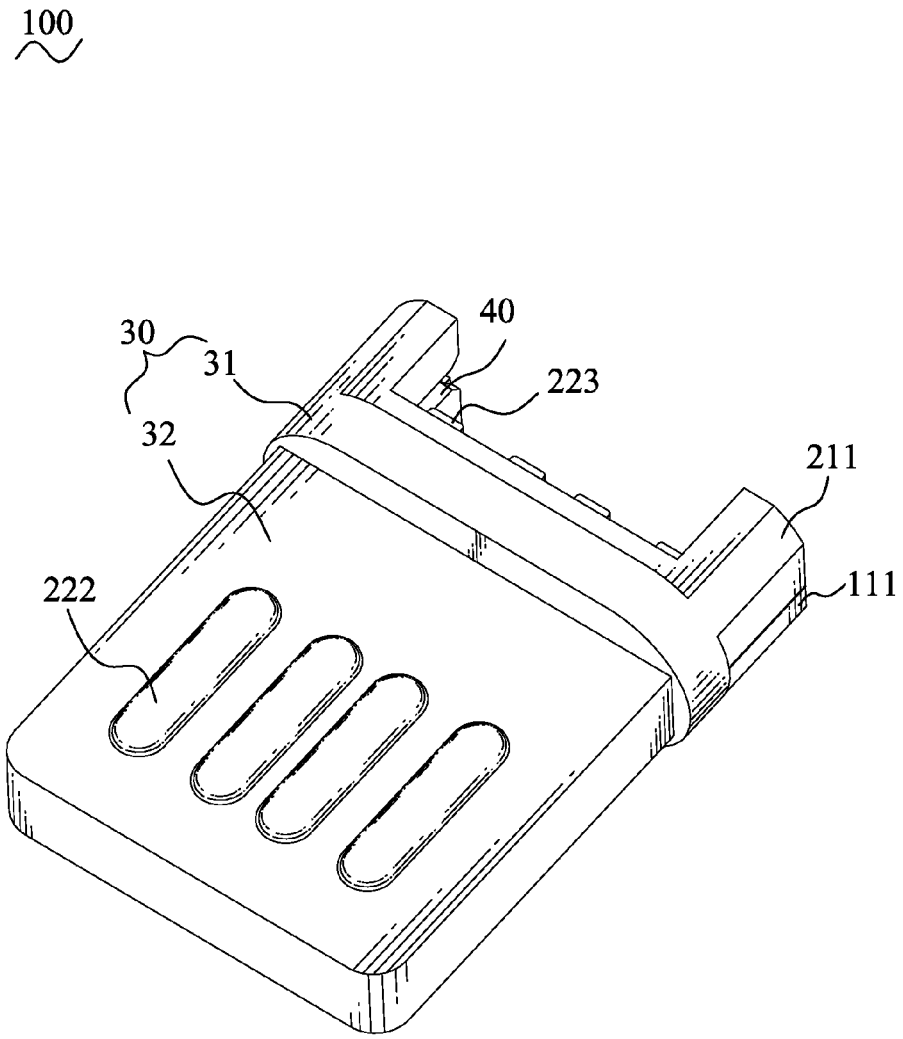
FIG. 1 is a perspective view of a plug connector according to an embodiment of the present invention.
Figure 3:
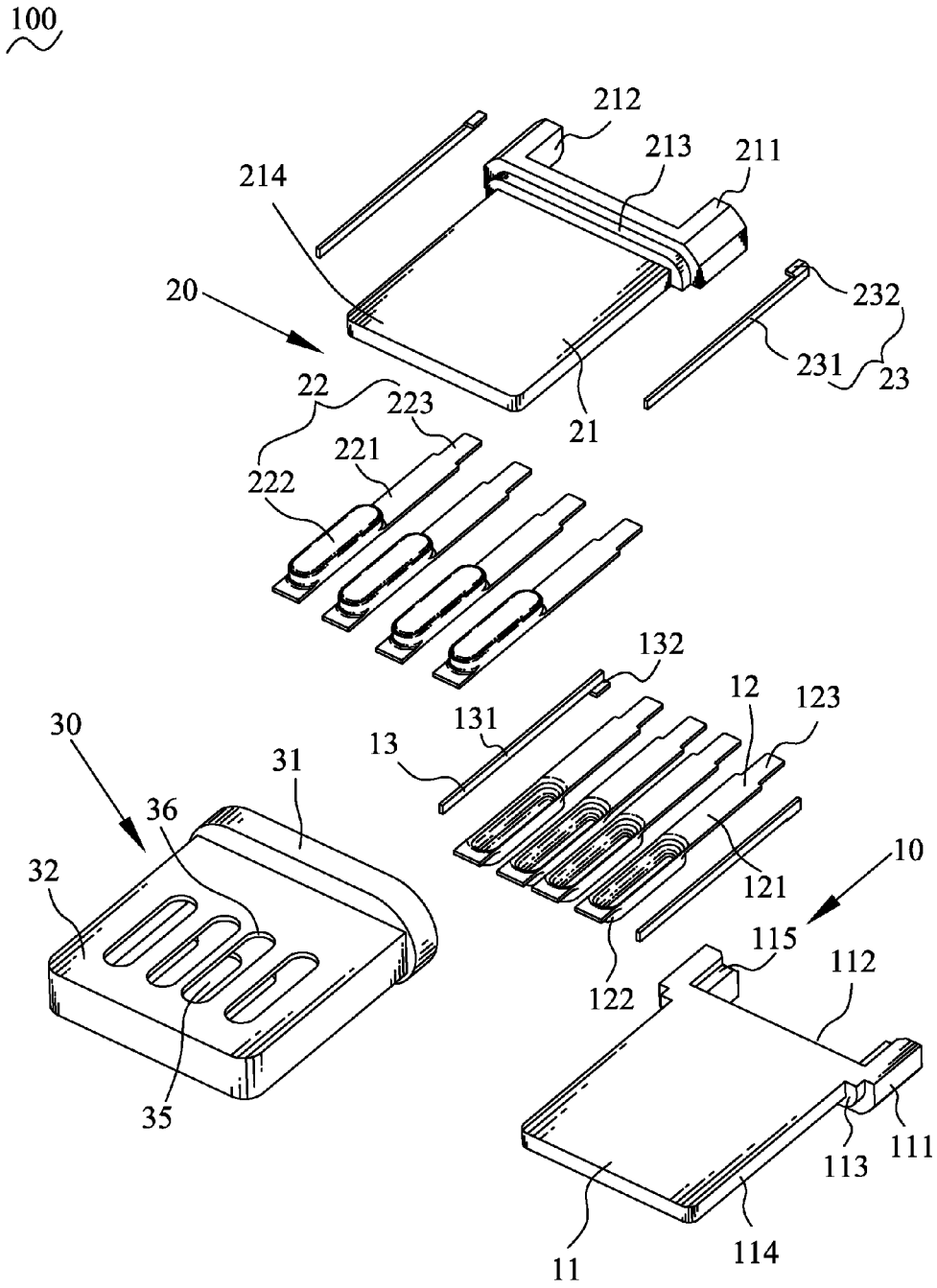
FIG. 3 is an exploded view of the plug connector of FIG. 1.

With reference to FIG. 1 and FIG. 3, an embodiment of the invention is embodied in a plug connector 100. The plug connector 100 is mounted on a printed circuit board (not shown), includes a lower terminal module 10, an upper terminal module 20 and an insulating housing 30.

Figure 2:
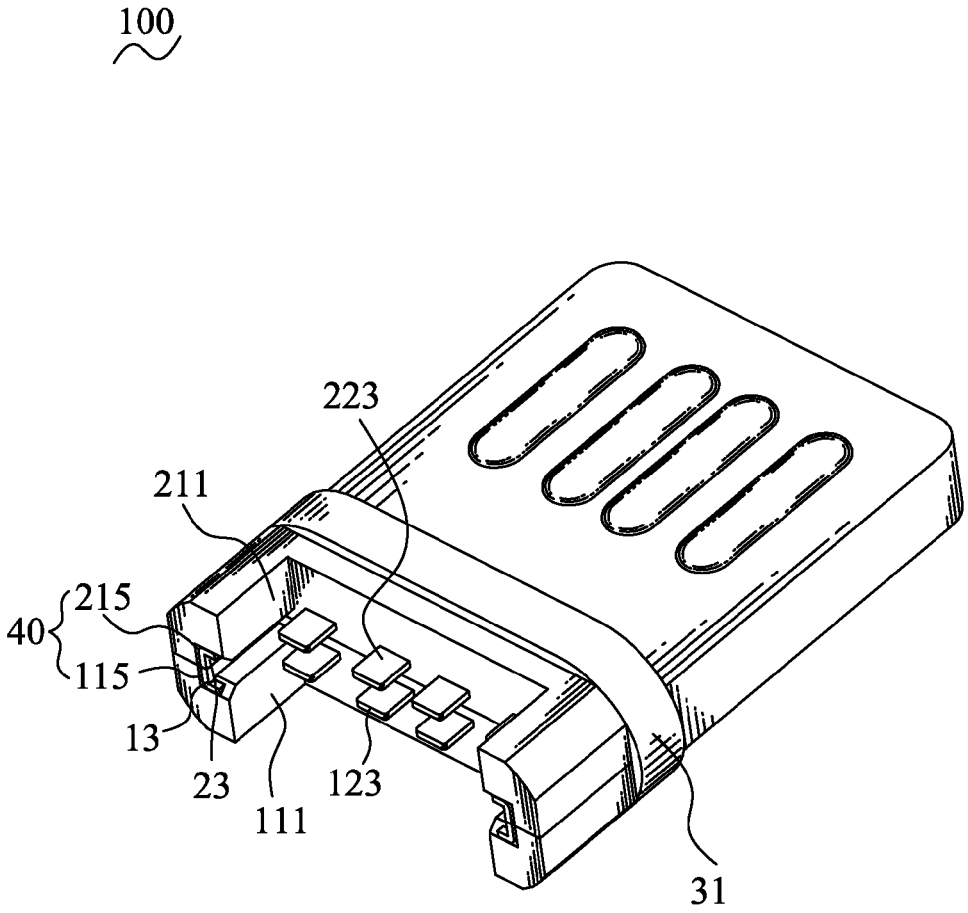
FIG. 2 is another perspective view of the plug connector of FIG. 1.

Referring to FIG. 2 and FIG. 3, the lower terminal module 10 includes a lower insulator 11, a plurality of lower terminals 12 and two lower reinforcing plates 13. The lower insulator 11 has a rectangular shaped lower base portion 111, a rear face of the lower base portion 111 defines a lower gap 112. A top of a front face of the lower base portion 111 extends frontward to form a lower extending portion 113, a front face of the lower extending portion 113 extends frontward to form a lower docking portion 114. Top faces of the lower base portion 111, the lower extending portion 113 and the lower docking portion 114 are in the same plane. The top face of the lower base portion 111 defines two lower guide grooves 115 communicated with two sides of the lower gap 112, respectively.

Each of the lower terminals 12 has a plate-shaped lower fixing portion 121, a front of the lower fixing portion 121 is drawn downward to form a lower contact portion 122 beyond a bottom face of the lower fixing portion 121, a rear of the lower fixing portion 121 extends rearwards to form a lower solder portion 123.

Each of the lower reinforcing plates 13 has a strip-shaped lower base plate 131, a bottom of a rear end of the lower base plate 131 extends and bends inwards perpendicularly to form a lower fixing foot 132.

The upper terminal module 20 is engaged with the lower terminal module 10, the upper terminal module 20 includes an upper insulator 21, a plurality of upper terminals 22 and two upper reinforcing plates 23. The upper insulator 21 has a rectangular shaped upper base portion 211, a rear face of the upper base portion 211 defines an upper gap 212 engaged with the lower gap 112. A bottom of a front face of the upper base portion 211 extends frontward to form an upper extending portion 213, a front face of the upper extending portion 213 extends frontward to form an upper docking portion 214. Bottom faces of the upper base portion 211, the upper extending portion 213 and the upper docking portion 214 are in the same plane. The bottom face of the upper base portion 211 defines two upper guide grooves 215 communicated with two sides of the upper gap 212, respectively.

Each of the upper terminals 22 has a plate-shaped upper fixing portion 221, a front of the upper fixing portion 221 is drawn upward to form an upper contact portion 222 beyond a top face of the upper fixing portion 221, a rear of the upper fixing portion 221 extends rearwards to form an upper solder portion 223.

Each of the upper reinforcing plate 23 has a strip-shaped upper base plate 231, a top of a rear of the upper base plate 231 extends and bends inwards perpendicularly to form a upper fastening foot 232.

Figure 4:
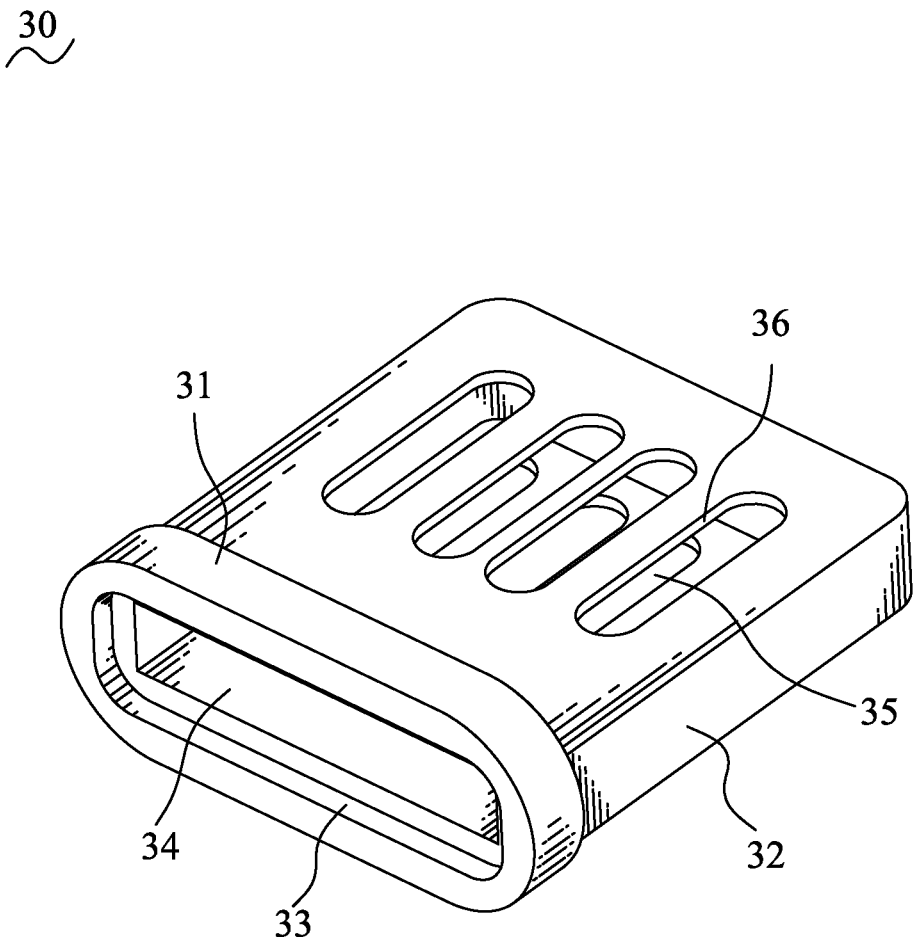
FIG. 4 is a perspective view of an insulating housing of the plug connector of FIG. 1.
Figure 5:
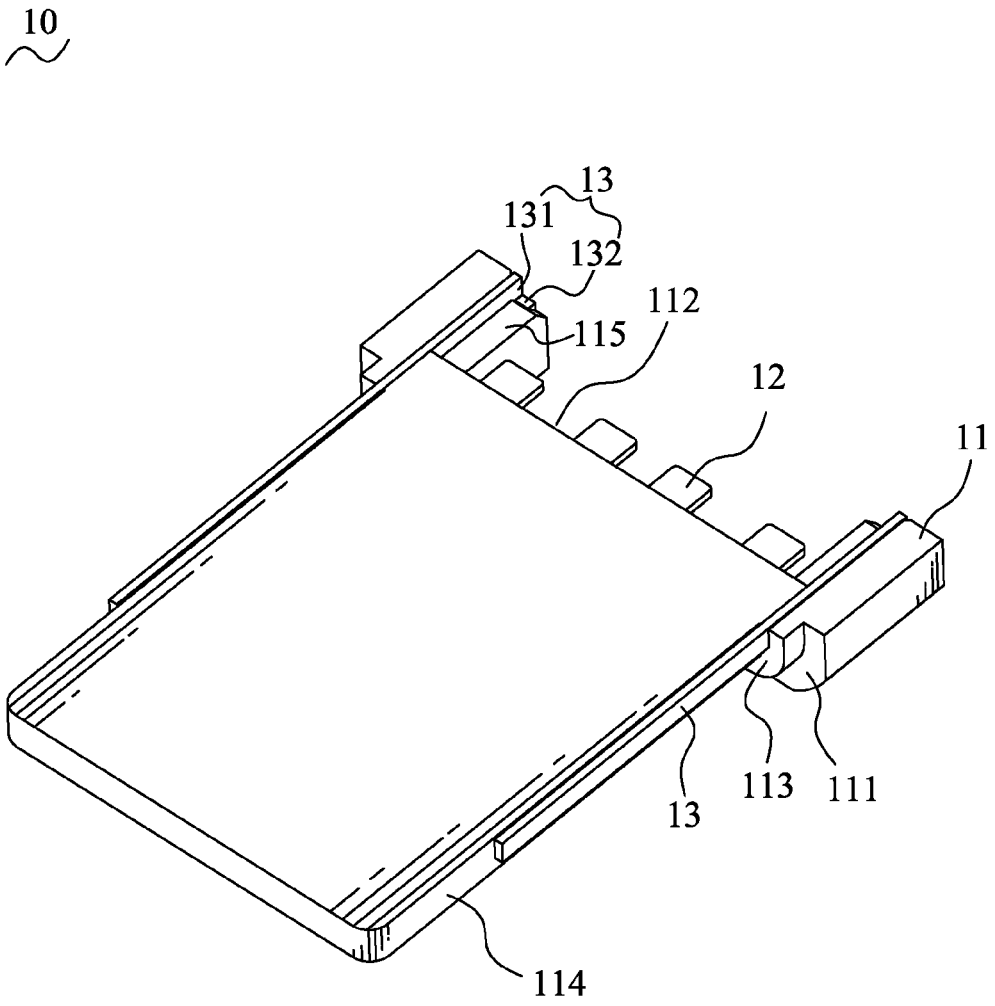
FIG. 5 is a perspective view of a lower terminal module of the plug connector of FIG. 1.
Figure 6:
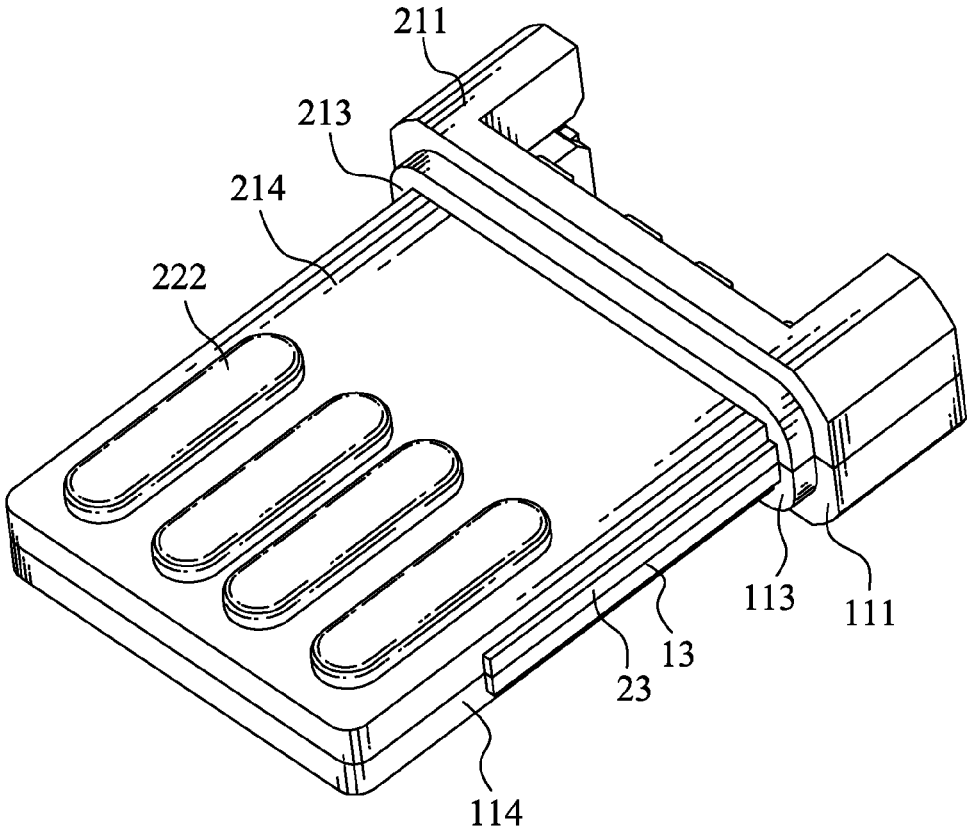
FIG. 6 is a perspective view of an assembly of the lower terminal module and an upper terminal module of the plug connector of FIG. 1.

Referring to FIG. 3 and FIG. 4, the insulating housing 30 has a body portion 31, a middle of a front face of the body portion 31 extends frontward to form a tongue board 32, a rear face of the body portion 31 defines a retaining opening 33. A front wall of the retaining opening 33 defines an inserting hole 34 extending into the tongue board 32. A bottom face of the tongue board 32 has a plurality of first grooves 35 extending into the inserting hole 34, a top face of the tongue board 32 has a plurality of second grooves 36 extending into the inserting hole 34.

Referring to FIG. 1 to FIG. 6, in assembly, the lower fixing portions 121 of the lower terminals 12 are integratedly molded in the lower insulator 11 and arranged transversely, the lower contact portions 122 are beyond a bottom face of the lower insulator 11, the lower solder portions 123 are beyond a rear of the lower insulator 11. In detail, the lower fixing portions 121 of the lower terminals 12 are integratedly molded in the lower base portion 111, the lower extending portion 113 and the lower docking portion 114, the lower contact portions 122 of the lower terminals 12 exceeds a bottom face of the lower docking portion 114, the lower solder portions 123 are exposed in the lower gap 112, top faces of the lower solder portions 123 and bottom walls of the lower guide grooves 115 are substantially in the same plane. A rear of the lower base plate 131 and the lower fastening foot 132 are integratedly molded in the lower base portion 111 and the lower extending portion 113. A front of the lower base plate 131 is beyond a front face of the lower extending portion 113 and attached on a sidewall of the lower docking portion 114.

The upper fixing portions 221 of the upper terminals 22 are integratedly molded in the upper insulator 21 and arranged transversely, the upper contact portions 222 are beyond a top face of the upper insulator 21, the upper solder portions 223 are beyond a rear of the upper insulator 21. In detail, the upper fixing portions 221 of the upper terminals 22 are transversely molded in the upper base portion 211, the upper extending portion 213 and the upper docking portion 214, the upper contact portions 222 of the upper terminals 22 exceeds a top face of the upper docking portion 214, the upper solder portions 223 are exposed in the upper gap 212, bottom faces of the upper solder portions 223 and top walls of the upper guide grooves 215 are substantially in the same plane. A rear of the upper base plate 231 and the upper fastening foot 232 are integratedly molded in the upper base portion 211 and the upper extending portion 213. A front of the upper base plate 231 is beyond a front face of the upper extending portion 213 and attached on a sidewall of the upper docking portion 214.

The upper terminal module 20 is engaged with the lower terminal module 10. In detail, the top faces of the lower base portion 111, the lower extending portion 113 and the lower docking portion 114 are engaged with the bottom faces of the upper base portion 211, the upper extending portion 213 and the upper docking portion 214. The lower gap 112 is engaged with the upper gap 212. The two lower guide grooves 115 and the two upper guide grooves 215 are engaged with each other to form two guide grooves 40.

The insulating housing 30 is integratedly molded outside the lower terminal module 10 and the upper terminal module 20. In detail, the body portion 31 of the insulating housing 30 is integratedly molded outside the lower extending portion 213 and the upper extending portion 113. The tongue board 32 is integratedly molded outside the lower docking portion 114, the upper docking portion 214 and the fronts of the lower base plates 131 and the upper base plates 231. The upper extending portion 213 and the lower extending portion 113 are molded in the retaining opening 33, the upper docking portion 214 and the lower docking portion 114 are molded in the inserting hole 34, the lower contact portions 122 are molded in the first grooves 35 and exposed from a bottom face of the tongue board 32 of the insulating housing 30, the upper contact portions 222 are molded in the second grooves 36 and exposed from a top face of the tongue board 32 of the insulating housing 30. The printed circuit board is installed in the two guide grooves 40, the top faces of the lower solder portions 123 are soldered on a bottom face of the printed circuit board, the bottom faces of the upper solder portions 223 are soldered on a top face of the printed circuit board.

As described above, the lower fixing portions 121 of the lower terminals 12 are integratedly molded in the lower insulator 11, the lower contact portions 122 are beyond the bottom face of the lower insulator 11. The upper fixing portions 221 of the upper terminals 22 are integratedly molded in the upper insulator 21, the upper contact portions 222 are beyond the top face of the upper insulator 21. The upper terminal module 20 and the lower terminal module 10 are engaged with each other and then integratedly molded in the insulating housing 30. Therefore, the plug connector 100 is adapted for normal insertion and reverse insertion into a receptacle connector (not shown) to facilitate users' usage, at the same time, the lower terminals 12 and the upper terminals 22 are convenient to molded in the lower insulator 11 and the upper insulator 21, the plug connector 100 has strong structure and low manufacturing cost.

What is claimed is:

1. A plug connector mounted on a printed circuit board, comprising:

a lower terminal module, including a lower insulator and a plurality of lower terminals, each of the lower terminals having a lower fixing portion, a front of the lower fixing portion being drawn downward to form a lower contact portion beyond a bottom face of the lower fixing portion, the lower fixing portions of the lower terminals being integratedly molded in the lower insulator and arranged transversely, each lower contact portion beyond a bottom face of the lower insulator, a rear of each lower fixing portion extending rearwards to form a lower solder portion beyond a rear of the lower insulator;

an upper terminal module engaged with the lower terminal module, the upper terminal module including an upper insulator and a plurality of upper terminals, each of the upper terminals having an upper fixing portion, a front of the upper fixing portion being drawn upwards to form an upper contact portion beyond a top face of the upper fixing portion, the upper fixing portions of the upper terminals being integratedly molded in the upper insulator and arranged transversely, each upper contact portion beyond a top face of the upper insulator, a rear of each upper fixing portion extending rearwards to form a upper solder portion beyond a rear of the upper insulator; and an insulating housing integratedly molded outside the lower terminal module and the upper terminal module, each lower contact portion exposed from a bottom face of the insulating housing, each upper contact portion exposed from a top face of the insulating housing.

2. The plug connector as claimed in claim 1, wherein the lower insulator has a lower base portion, a top of a front face of the lower base portion extends frontward to form a lower extending portion, a front face of the lower extending portion extends frontward to form a lower docking portion, top faces of the lower base portion, the lower extending portion and the lower docking portion are in the same plane, the upper insulator has an upper base portion, a bottom of a front face of the upper base portion extends frontward to form an upper extending portion, a front face of the upper extending portion extends frontward to form an upper docking portion, bottom faces of the upper base portion, the upper extending portion and the upper docking portion are in the same plane, the top faces of the lower base portion, the lower extending portion and the lower docking portion are engaged with the bottom faces of the upper base portion, the upper extending portion and the upper docking portion.

3. The plug connector as claimed in claim 2, wherein the lower fixing portions of the lower terminals are integratedly molded in the lower base portion, the lower extending portion and the lower docking portion, the lower contact portions of the lower terminals exceeds a bottom face of the lower docking portion, the upper fixing portions of the upper terminals are integratedly molded in the upper base portion, the upper extending portion and the upper docking portion, the upper contact portions of the upper terminals exceeds a top face of the upper docking portion.

4. The plug connector as claimed in claim 3, wherein the insulating housing has a body portion, a middle of a front face of the body portion extends frontward to form a tongue board, the body portion of the insulating housing is integratedly molded outside the lower extending portion and the upper extending portion, the tongue board is integratedly molded outside the upper docking portion and the lower docking portion, the lower contact portions are exposed from a bottom face of the tongue board of the insulating housing, the upper contact portions are exposed from a top face of the tongue board of the insulating housing.

5. The plug connector as claimed in claim 3, wherein the lower terminal module further includes two lower reinforcing plates integratedly molded in the lower insulator, each of the lower reinforcing plates has a strip-shaped lower base plate, a bottom of a rear end of the lower base plate extends and bends inwards perpendicularly to form a lower fixing foot, a rear of the lower base plate and the lower fastening foot are integratedly molded in the lower base portion and the lower extending portion, a front of the lower base plate is beyond a front face of the lower extending portion and attached on a sidewall of the lower docking portion; the upper terminal module further includes two upper reinforcing plates integratedly molded in the upper insulator, each of the upper reinforcing plates has a strip-shaped upper base plate, a top of a rear of the upper base plate extends and bends inwards perpendicularly to form a upper fastening foot, a rear of the upper base plate and the upper fastening foot are integratedly molded in the upper base portion and the upper extending portion, a front of the upper base plate is beyond a front face of the upper extending portion and attached on a sidewall of the upper docking portion.

6. The plug connector as claimed in claim 3, wherein a rear face of the lower base portion defines a lower gap, a rear face of the upper base portion defines an upper gap engaged with the lower gap, the lower solder portion is exposed in the lower gap, the upper solder portion is exposed in the upper gap.

7. The plug connector as claimed in claim 6, wherein a top face of the lower base portion defines two lower guide grooves communicated with two sides of the lower gap, respectively, a bottom face of the upper base portion defines two upper guide grooves communicated with two sides of the upper gap, respectively, the two lower guide grooves and the two upper guide grooves are engaged with each other to form two guide grooves; a top face of the lower solder portion and bottom walls of the lower guide grooves are substantially in the same plane, a bottom face of the upper solder portion and top walls of the upper guide grooves are substantially in the same plane, the printed circuit board is installed in the two guide grooves, the top face of the lower solder portion is soldered on a bottom face of the printed circuit board, the bottom face of the upper solder portion is soldered on a top face of the printed circuit board.

* * * * *